US008281858B2

(12) United States Patent
Challacombe

(10) Patent No.: US 8,281,858 B2
(45) Date of Patent: Oct. 9, 2012

(54) SHOT PERFORATOR DEVICE AND METHOD FOR WATER WELL BORE DECOMMISSIONING

(76) Inventor: Bradley J. Challacombe, Anaheim, CA (US)

( * ) Notice: Subject to any disclaimer, the term of this patent is extended or adjusted under 35 U.S.C. 154(b) by 287 days.

(21) Appl. No.: 12/544,002

(22) Filed: Aug. 19, 2009

(65) Prior Publication Data

US 2011/0042087 A1 Feb. 24, 2011

(51) Int. Cl.
*E21B 33/13* (2006.01)

(52) U.S. Cl. ..... 166/286; 166/177.4; 166/63; 166/299; 175/4.55; 89/1.15; 89/1.151; 102/333

(58) Field of Classification Search ..... 175/2, 4.54, 175/4.5; 166/63, 286, 299, 177.4, 285, 297, 166/283; 89/1.15, 1.151; 102/301–333, 102/275.8, 275.1, 275.7, 275.2–4
See application file for complete search history.

(56) References Cited

U.S. PATENT DOCUMENTS 2,246,611 A * 6/1941 Zandmer ..... 166/299
2,591,807 A * 4/1952 Greene ..... 166/286
3,150,590 A * 9/1964 Silverman ..... 181/116
6,439,121 B1 * 8/2002 Gillingham ..... 102/312

OTHER PUBLICATIONS

Blasting and the Use of Explosives. Retrieved Jun. 21, 2011, from http://www.osha.gov/doc/outreachtraining/htmlfiles/blasting.html.*

* cited by examiner

*Primary Examiner* — Kenneth L Thompson
*Assistant Examiner* — Ronald Runyan
(74) *Attorney, Agent, or Firm* — Steins & Associates, P.C.

(57) ABSTRACT

Application of the method and device to a water well will permanently seal the well casing in order to prevent hydraulic cross-contamination with other water wells in the area. The method employs a string to explosive modules in spaced relation along the depth of a well casing. This weighted string of explosive modules is lowered into the well casing, wet concrete should then be introduced into the casing, after which the explosive elements are detonated sequentially, starting at the top of the well. Detonation of the elements in such a manner should force the wet concrete or cement out through the well casing perforations, so that the well casing will be entirely captured within the cured concrete. The individual explosive elements are made from detonating cord and metallic ball bearings wrapped into bundles, and then the bundles are bound in suitable adhesive tape.

15 Claims, 7 Drawing Sheets

SHOT PERFORATOR DEVICE AND METHOD FOR WATER WELL BORE DECOMMISSIONING

BACKGROUND OF THE INVENTION

1. Field of the Invention

This invention relates generally to water well operations and, more specifically, to a Shot Perforator Device and Method for Water Well Bore Decommissioning.

2. Description of Related Art

At the end of the life of a water well, it is generally not desirable to simply leave the well as an abandoned hole. The fear is that fall hazards, source contamination, or terrain collapses may occur and so it is not uncommon to be required to decommission the well by some means.

In the past, wells have been decommissioned through a variety of unsafe and/or ineffective methods. These methods have included attempts to fill the well casing with sand or gravel or even with concrete or cement. The problem with filling the casing is that only the inside of the casing is being filled as a result of these approaches and the surrounding area around the outside of the well casing remains a void that can cause future safety issues.

A more recent example of a method for well decommissioning is shown in Turley, et al., U.S. Patent Publication No. 2008/0128133. While Turley seeks to safeguard the abandoned well, it essentially uses a plug to do so. Although this approach will safeguard the top of the well for the purposes of falling hazards, it will not prevent cross contamination and future erosion of the terrain surrounding the well. What is needed is a system and method that will decommission a well and leave it in a condition that is safe from hydraulic cross contamination, erosion issues and fall hazards.

SUMMARY OF THE INVENTION

In light of the aforementioned problems associated with the prior systems and methods, it is an object of the present invention to provide a Shot Perforator Device and Method for Water Well Bore Decommissioning. Application of the method and device to a water well should permanently seal the well casing in order to prevent cross-contamination with other water wells in the area. The method should employ a string of explosive modules in spaced relation along the depth of a well's blank casing. This weighted string of explosive modules should be lowered into non-perforated sections of the well casing, wet concrete should then be introduced into the casing, after which the explosive elements should be detonated sequentially, starting at the top of the well. Detonation of the elements in such a manner should force the wet concrete or cement out through the newly-created well casing perforations, so that the well casing will be entirely encapsulated within the cured concrete. The individual explosive elements should be made from detonating cord and metallic ball bearings wrapped into bundles, and then the bundles should be wrapped up in suitable adhesive tape.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Shot Perforator Device and Method for Water Well Bore Decommissioning.

The device of the present invention and the method to use it involves the use of a custom-built, liner-shaped explosive device that will catastrophically destroy and decommission an abandoned water well bore. The objective of the device and method is to perforate and/or breach the well's casing while simultaneously injecting liquid cement or concrete just outside the well's casing (through the holes in the well casing). This process will prevent any hydraulic cross contamination from the well being decommissioned with any surrounding active or future well sites.

Figure 1:
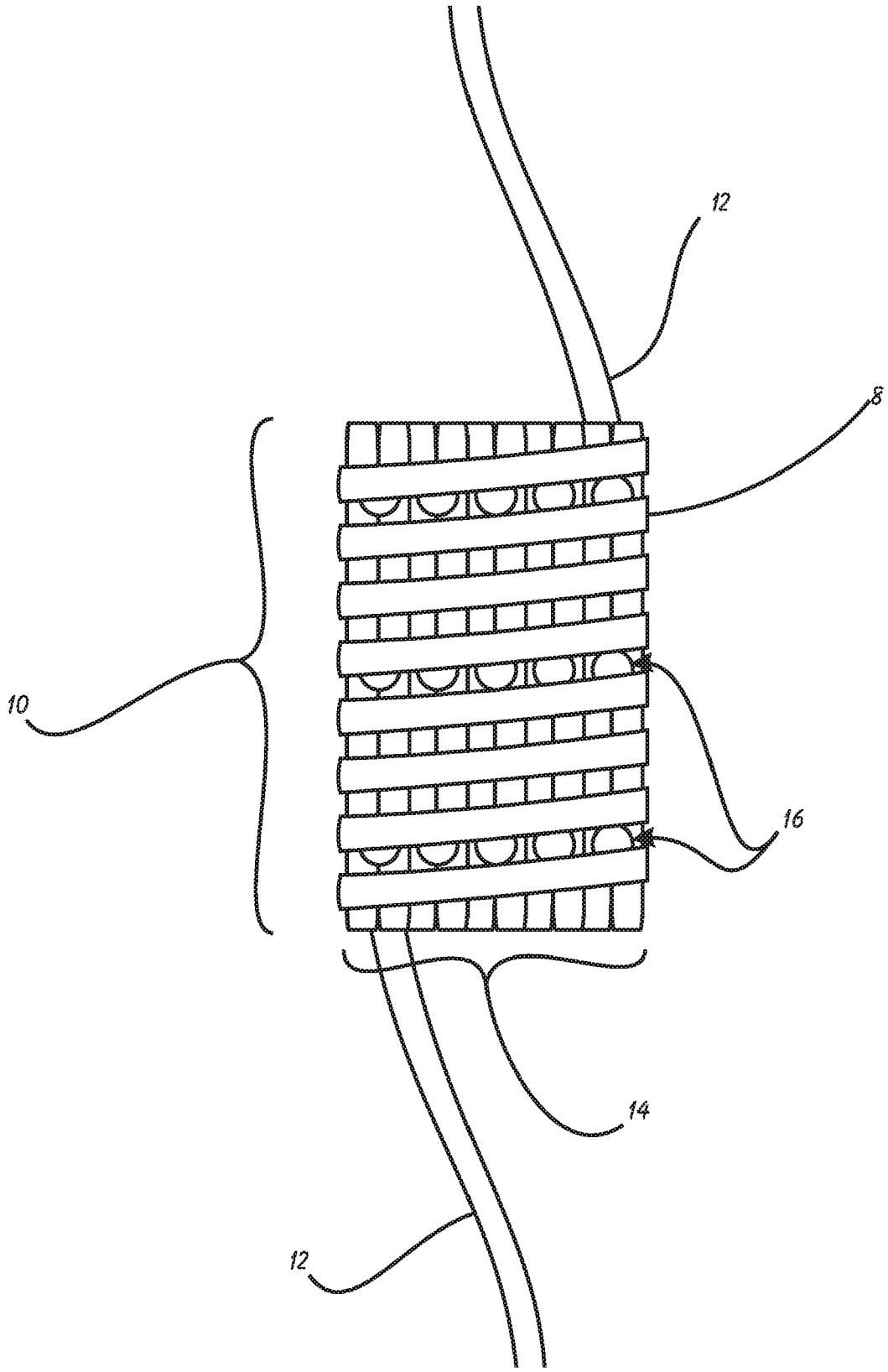
FIG. 1 is a partial side view of a preferred embodiment of a perforation element of the system of the present invention.

The present invention can best be understood by initial consideration of FIG. 1. FIG. 1 is a partial side view of a preferred embodiment of a perforation element of the system of the present invention. The discrete item used to make up the decommissioning system is a perforation element 10. A perforation element is a bundle of custom detonating cord wrapped in an explosive bundle along with several carbon steel ball bearings that will essentially create an explosive device that will shoot these ball bearings into the walls of the casing thereby creating perforations through which liquid concrete or cement can pass to the outside of the well casing.

The perforation element 10 comprises an explosive bundle made of a number of wraps 14 in a detonating cord 12. The detonating cord preferably has a double layer PVC jacket that provides a water-tight environment and additional protection to the explosive material on the inside of the cord 12. Since it is not uncommon for the system to be left sitting in water and/or liquid concrete or cement for ten hours or more in the course of the decommissioning process, the number of wraps 14 is guided by the size and condition of the well itself. For example, a perforation element 10 may have five to seven wraps 14 for well casings having a four- to six-inch diameter. In another example, 21 to 23 wraps 14 are used for a diameter of 20 to 22 inches. While the wraps 14 are created, a plurality of ball bearings 16 are being added along the way. These ball bearings 16 are preferably ⅜-inch diameter of carbon steel material; however, other size and composition bearings may be suitable. Once the wraps are complete for the element 10, the element 10 will be bound with tape 8 such as conventional electrical tape. The binding tape 18 serves to increase the load factor of the explosives so that less explosives will create a more severe detonation and damage to the well casing. As shown here, the detonating cord 12 extends both upwardly and downwardly to the next element in the string.

Figure 2:
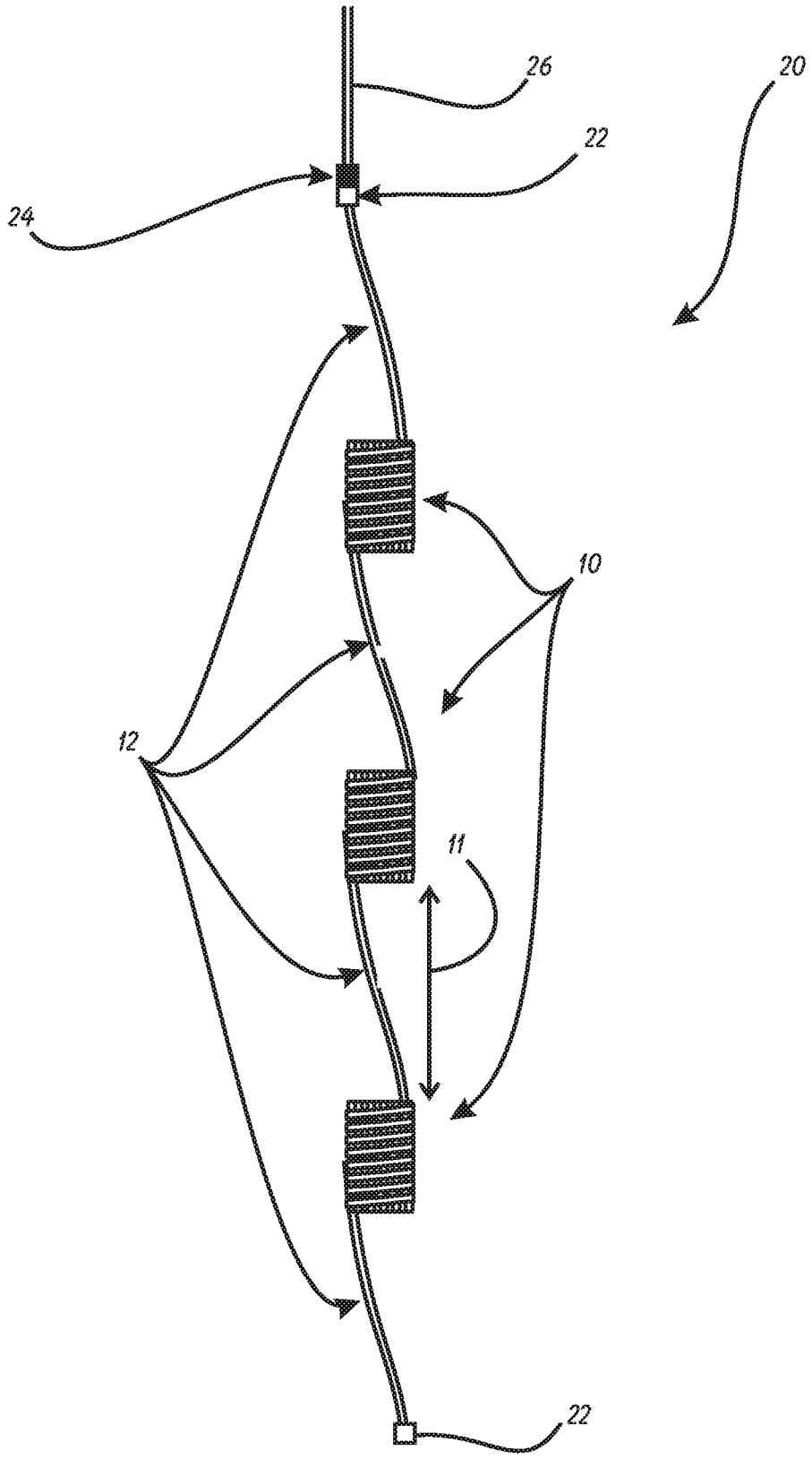
FIG. 2 is a shot perforation module utilizing three of the elements of FIG. 1.

If we now turn to FIG. 2, we can examine how these elements are interrelated. FIG. 2 is a shot perforation module utilizing three of the elements of FIG. 1. It should be understood that this is merely an example of how a series of elements 10 are interconnected to create each module 20. Each module 20 is generally forty-six (46) feet in length, with the spacing 11 between elements 10 being between two and three feet (per element).

In this depiction, the first shot perforation module 20 is shown. This module 20 would be the top module in a string of modules making up the entire assembly as will be shown in more detail below in connection with FIG. 4. The detonating cord 12 interconnects three shot perforation elements 10 as depicted above in FIG. 2. The elements 10 are spaced by element spacing 11. This spacing 11 will change depending on the diameter and condition of the well casing. For example, it is typical to have two-foot spacing for well casings having diameters of less than 12 inches while three-foot spacing would be used for those well casings equal to or greater than 12 inches in diameter. At the top end of the first shot perforation module 20, the detonating cord terminates in a seal cap 22 which will be discussed below in connection with FIG. 3. A detonator 24 is attached to the seal cap 22 and this detonator 24 will control the detonation of the entire first shot perforation module 20. The other modules discussed below in FIG. 4 each have their own detonator. A lead line 26 extends from the first detonator to a safe area away from the well casing. The lead line 26 is an electrical cable that's used to detonate the detonators 24. At the bottom end of the module 20, a second seal cap 22 isolates the detonating cord 12 of the first shot perforation module 20 from the rest of the modules making up the system.

Figure 3:
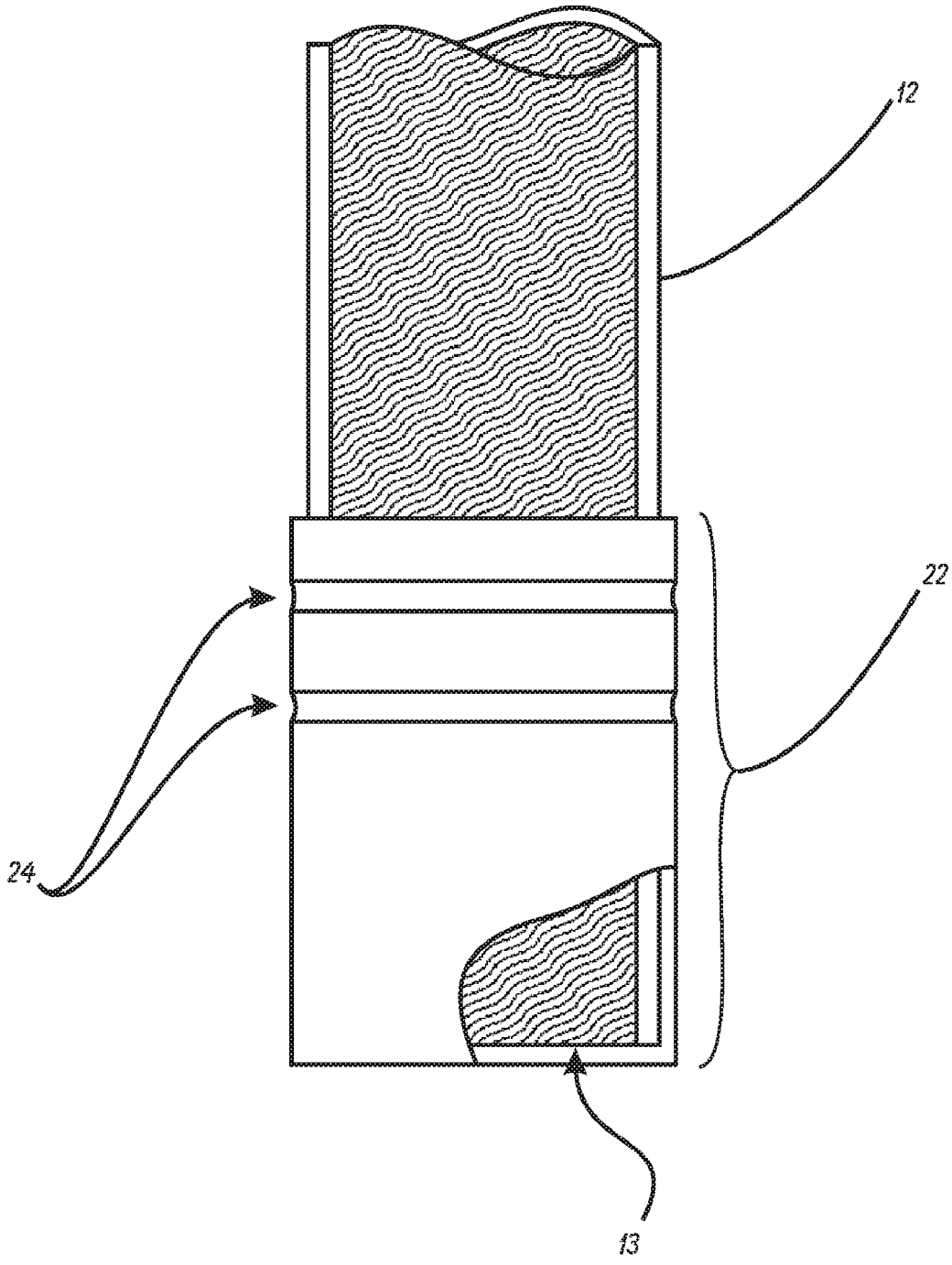
FIG. 3 is a partial cutaway side view of a seal cap used in the module of FIG. 2.

FIG. 3 discusses the structure of the seal cap. FIG. 3 is a partial cutaway side view of a seal cap used in the module of FIG. 2. As shown here, the detonating cord 12 terminates in an end 13 which could be just a blank end as shown here or it could be an end where a detonator would be located. The seal cap 22 is a metal cap slid over the end 13 and then maintained in place permanently by a series of crimps 24. The seal cap 22 prevents liquid from penetrating into the detonating cord and interfering with the explosive capability of the cord 12.

Figure 4:
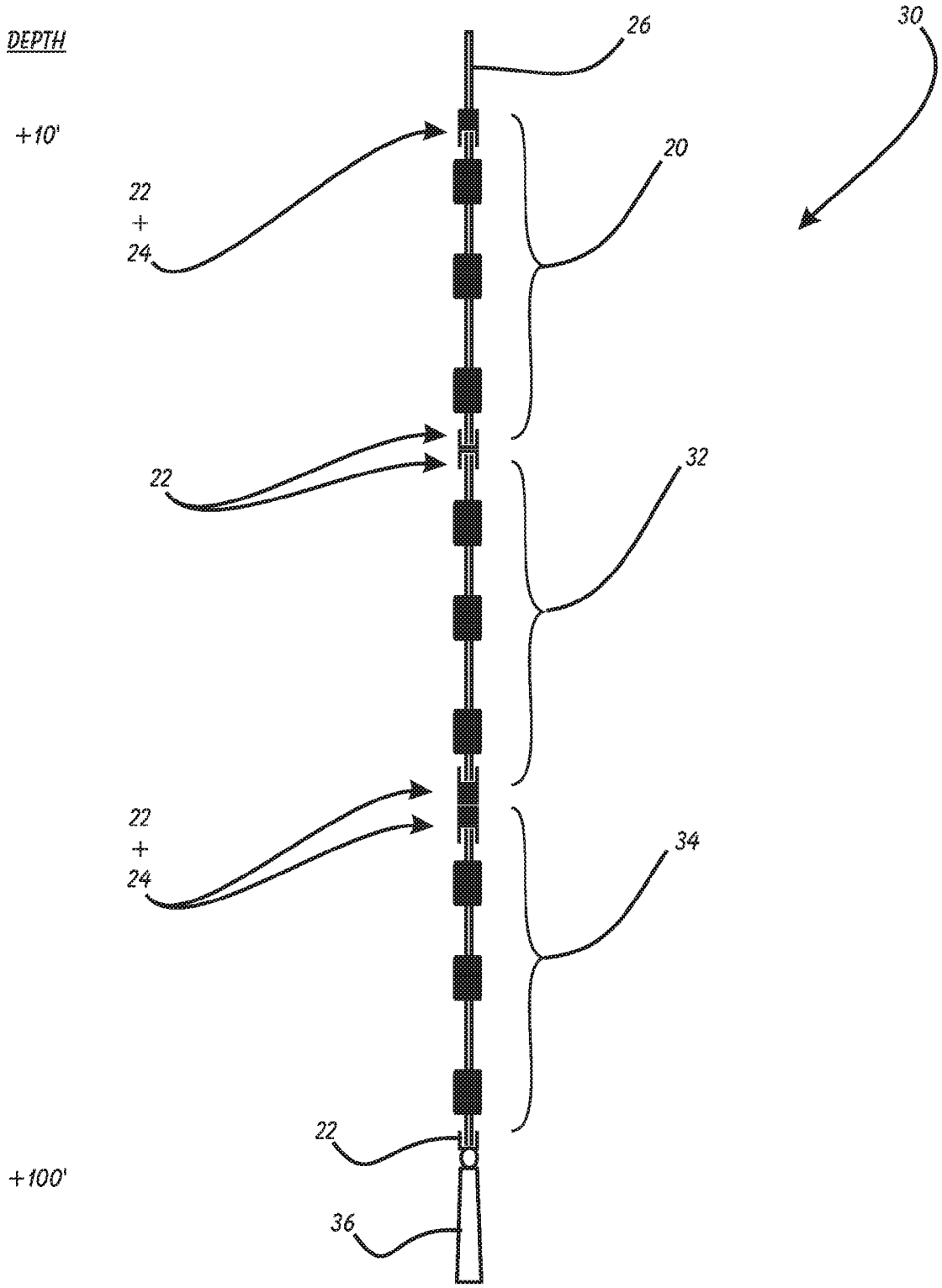
FIG. 4 is a side view of a shot perforation assembly of the present invention using the modules and elements of FIGS. 1 and 2.

FIG. 4 shows the overall shot perforation assembly. FIG. 4 is a side view of a shot perforation assembly of the present invention using the modules and elements of FIGS. 1 and 2. As shown here, a series of modules 20, 32, 34 are interconnected and spaced out along the length of the well casing. At the bottom end, a weight 36 is hung from a long piece of wire, such as piano wire, that runs the entire length of the assembly 30. The wire (not shown) supports all of the elements of the modules 20, 32, 34, and is tied off at its end at the weight 36. The wire relieves the stress of the hanging weight from the detonating cord interconnecting the modules and elements.

The weight 36, hanging from the assembly 30 below the third module 34 serves to prevent the shot perforation assembly 30 from floating upward from its desired pre-detonation position when the wet cement or concrete is introduced into the well casing. The weight 36 is at least ten pounds in weight and has a length that is greater than the casing diameter. These aspects will also aid in preventing the assembly 30 from floating away from its placement position. As discussed above, the lead line 26 terminates at the detonator 24 and seal cap 22 which comprised the top end of the first perforation module 20. The second perforation module 32 terminates in a seal cap at its top end and a seal cap 22 and detonator 24 at its bottom end. Similar to the first module 20, the third module 34 has a seal cap 22 and detonator 24 at its top end and terminates in a seal cap 22 at its bottom end. Generally the upper seal cap 22 and detonator 24 for the complete assembly 30 is placed approximately 6 to 10 feet below the surface of the wet cement or concrete and can extend as deep as 100 or 150 feet. A typical module length is approximately 46 feet, with a elements spaced at approximately 2 to 3 feet. The lead line 26 is generally fifteen (15) feet long, with its conductive end fitting being connected to a Shooting Panel (device outside of the well area that controls the detonation).

Figure 5:
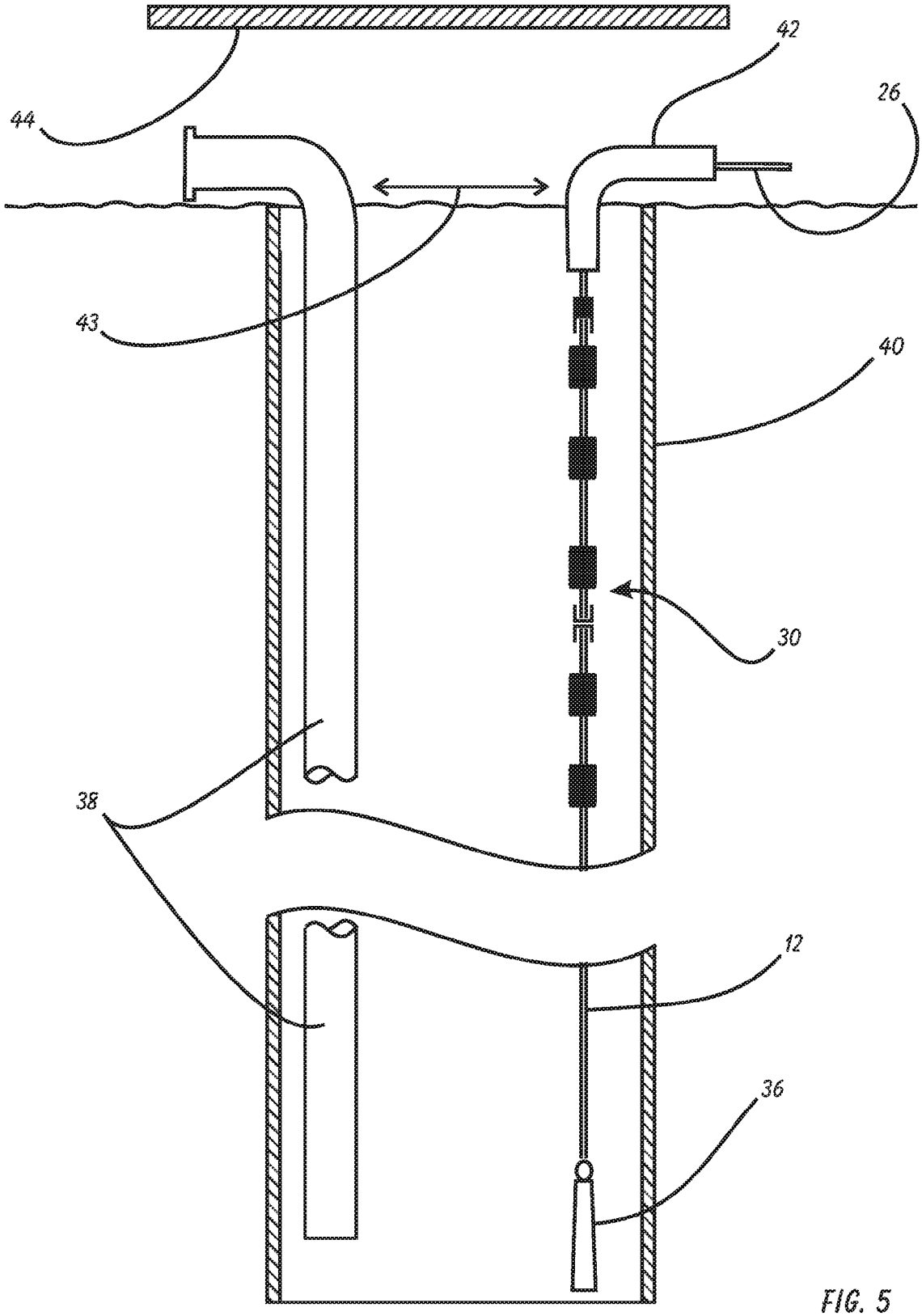
FIG. 5 is a cutaway side view of a well casing where the method of the present invention is being executed.

FIG. 5 depicts the initial steps of the perforation process. FIG. 5 is a cutaway side view of a well casing where the method of the present invention is being executed. In FIG. 5 we see prior to detonation of the assembly 30. A trim pipe 38 has been inserted into the well casing 40 so that liquid concrete or cement can be introduced to the well casing 40 all the way at the bottom of the well casing 40 without damage to the assembly 30. A concrete pumper would be hooked up to the top end of the trim pipe 38 in order to introduce the concrete. The perforation assembly 30 is dropped into the well casing 40 and the lead line 26 is threaded out through a protective sleeve 42. The protective sleeve 42 is typically going to be made from a plastic material that is hard to prevent crushing yet flexible to allow for adjustment due to terrain or orientation of the other elements in the system. Once the concrete has been completely introduced into the well casing, the trim pipe is removed and the cover plate 44 is laid atop the protective sleeve 42 and then chained to the ground.

As discussed above, the lead line 26 extends approximately ten (10) feet down into the well casing 40, leaving approximately five (5) feet of lead line 26 outside of the well casing 40, connected to the shooting panel (not shown).

Figure 6A:
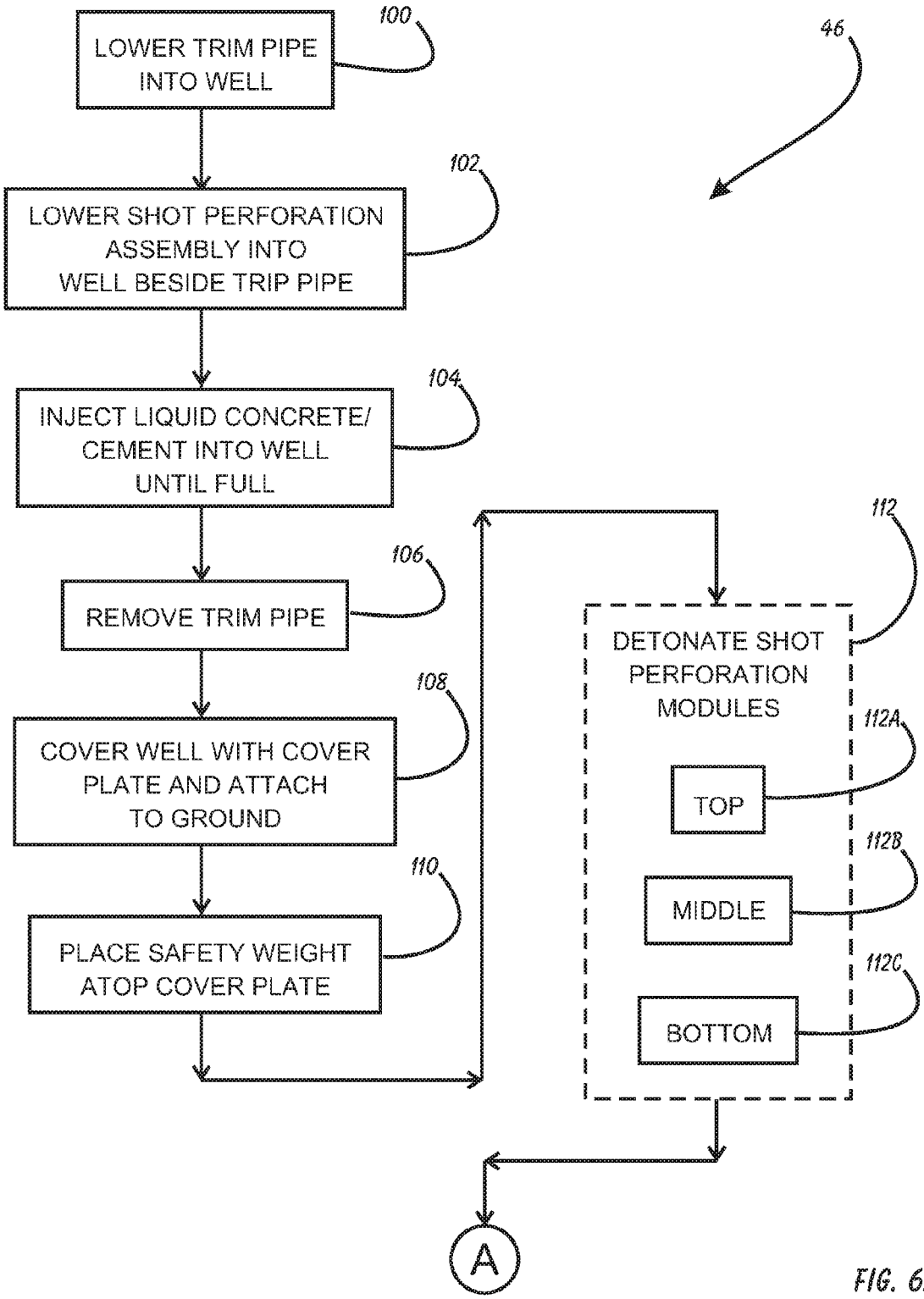
FIGS. 6A and 6B are a flow chart depicting the steps of a preferred embodiment of the well decommissioning method by catastrophic perforation of the present invention.
Figure 6B:
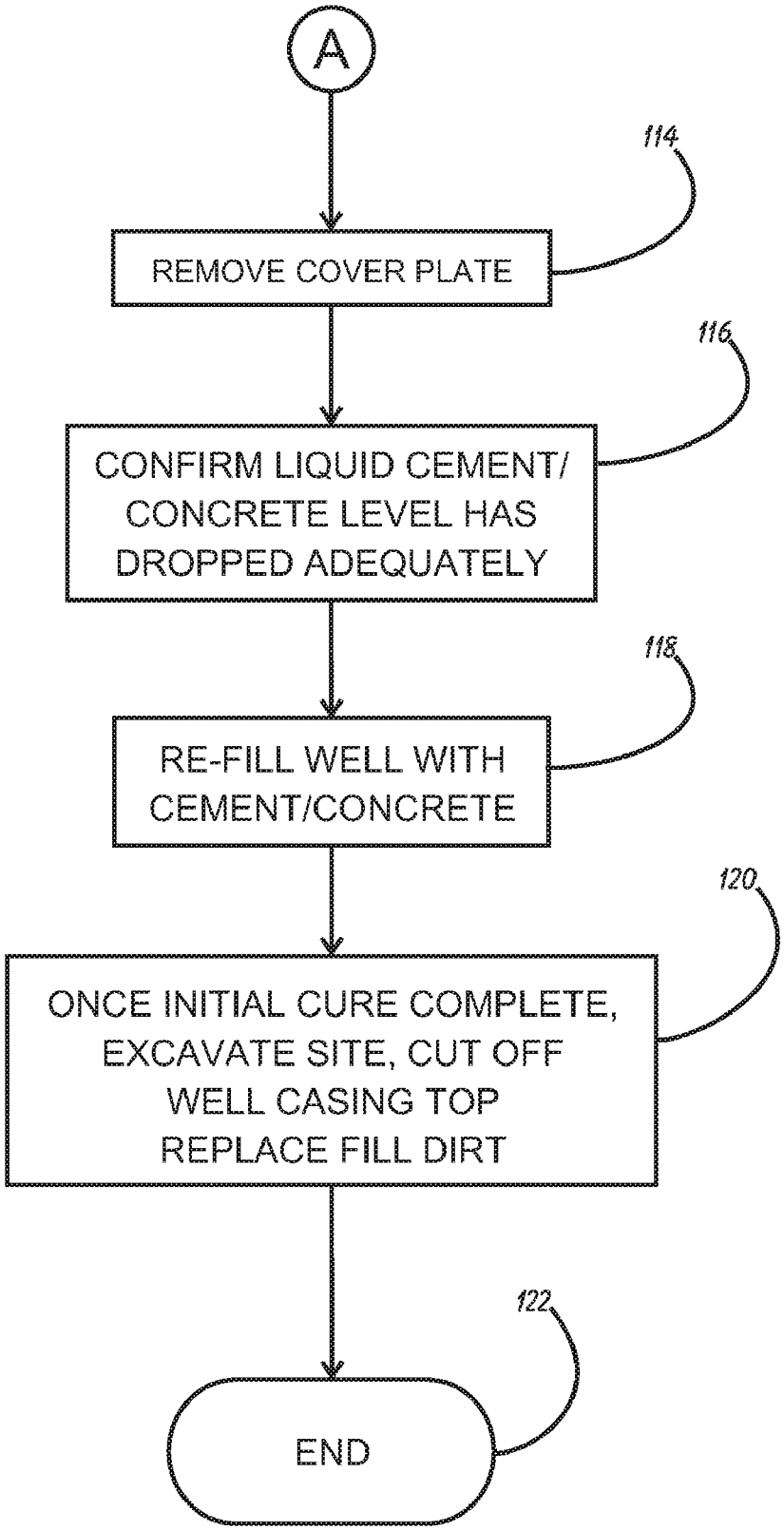

The flow chart of FIGS. 6*a* and 6*b* provide additional detail regarding this new method. FIGS. 6*a* and 6*b* are a flow chart depicting the steps of a preferred embodiment of the well decommissioning method by catastrophic perforation of the present invention. The well decommissioning method by catastrophic perforation 46 commences by lowering the trim pipe into the well 100 as shown above in FIG. 5; however, in order to create the perforation assembly, the well casing must first be inspected by camera in order to derive the placement and number of wraps on the perforation elements of binding tape as well as the spacing of the perforation elements which is a function of the diameter, age and condition of the well casing. The only way to truly ascertain these conditions is through visual inspection. Once the trim pipe has been lowered into the well 100 the shot perforation assembly is lowed into the well casing beside the trim pipe 102. At this point, liquid concrete or cement is injected into the well until the well casing is full 104. The trim pipe is then removed 106 and the well is covered with a cover plate that is then attached to the ground with chains 108. Generally a safety weight is placed atop the cover plate 110 such as a 300-pound dead weight that can be easily lifted by a forklift or crane. Once the safety weight is in place, the shot perforation modules are detonated 112. What is unique here is that the elements are not detonated simultaneously, but rather are detonated sequentially. The top module is detonated first 112*a* after which the middle module is detonated 112*b* and then the bottom module is finally detonated 112*c*. The modules are detonated at approximately one-and-a-half second intervals. The result is to utilize the weight and viscosity of the cement or concrete and to sequentially cause the concrete to compress down into the well and push out through the perforations formed in the wall of the well casing. This creates a continuous squeezing effect, forcing wet concrete or cement to be pushed down and out through the perforations into the surrounding area around the well casing. Once the detonations have occurred, the cover plate is removed 114 and a mechanical depth sounding is performed in order to confirm that the liquid concrete or cement level has dropped adequately. It is common for that liquid level to drop one-third the overall length of the shot perforation assembly 30. The well is then refilled with cement or concrete 118 to within five feet of the top of the well. Approximately 24 hours later after the initial cure is complete, the area around the well casing is excavated to a depth of approximately ten feet, the top of the well casing is cut off and removed, a cement or concrete "mushroom cap" is poured over the casing, and, finally, the hole is refilled with the dirt that was initially removed 120 which then completes the method 122.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method for decommissioning water wells defined by a subterranean casing, and an open mouth at its upper end, the method comprising the steps of:

lowering a shot perforation assembly into the water well, wherein said shot perforation assembly of said lowering step comprises three perforation modules in spaced relation along detonating cord, each said perforation module having its own detonator device independent of said other modules;

injecting liquid concrete or cement directly into said water well to at least cover said shot perforation assembly;

placing and securing a cover plate over said mouth;

detonating said shot perforation assembly, said detonation configured to drive said liquid concrete out through apertures formed in the casing; and further comprising placing additional liquid concrete or cement in the casing after said detonating step until the casing is substantially filled with said concrete or cement.

2. The decommissioning method of claim 1, wherein said detonating step comprises detonating each said perforation module individually in a pre-programmed sequence.

3. The decommissioning method of claim 2, wherein said detonating step further consists essentially of detonating each said perforation module in time spaced relation by one and one-half seconds.

4. The decommissioning method of claim 2, wherein each said perforation module of said lowering step comprises one or more perforation elements, each said perforation element comprising:

a length of explosive detonating cord selectively wrapped into a bundle of a predetermined number of said wraps;

a plurality of hard projectile elements integrated within said wrapped bundle; and a binding element binding said wraps and hard projectile elements into a tight bundle.

5. The decommissioning method of claim 4, wherein each said perforation module of said lowering step comprises three said perforation elements in relative spaced relation along said detonating cord.

6. The decommissioning method of claim 5, wherein each said perforation module of said lowering step comprises a separate length of said detonating cord comprising said perforation elements and terminating in opposing ends in sealing caps crimped to said ends, said sealing caps creating liquid-tight seals at said ends.

7. The decommissioning method of claim 6, wherein each said perforation module of said lowering step comprises a detonator device attached to one said sealing cap.

8. The decommissioning method of claim 7, wherein:

said injecting step is preceded by an insertion step wherein a trim pipe is inserted into said casing until it reaches substantially to the bottom of said well;

said injecting step comprises injecting said concrete or cement into the upper end of said trim pipe; and said detonating step is preceded by a removal step wherein said trim pipe is removed from said casing.

9. The decommissioning method of claim 8, wherein said perforation assembly of said lowering step further comprises a ballast element attached to the lowest end of the lowest said perforation module.

10. A well decommissioning assembly, comprising:

one or more perforation modules, each said module comprising:

a segment of detonating cord terminating in sealing caps crimped to opposing ends thereof;

at least one perforation element comprising a bundle of wrapped detonating cord formed in said detonating cord between said opposing ends, the wrapping of said wrapped detonating comprising binding tape encircling said each said bundle, each said perforation element further comprising a plurality of hard projectile elements integrated within said bundle; and a detonator device attached to one said opposing end and electrically connected to a lead line.

11. The assembly of claim 10, wherein each said perforation element comprises said binding tape encircling said bundle of wrapped detonating cord and said projectile elements.

12. The assembly of claim 11, wherein each said perforation module comprises three said perforation elements in relative spaced relation along said detonating cord.

13. The assembly of claim 12, comprising three said perforation modules, wherein said detonator devices each detonate in relative time-spaced relation, commencing at a top said perforation module, next detonating a middle perforation module, and finally detonating a bottom perforation module.

14. The assembly of claim 13, wherein said time spacing between said detonations is approximately one and one-half seconds.

15. The assembly of claim 14, wherein said perforation elements are spaced from between two and three feet from said other said perforation elements comprising a respective said perforation module.

* * * * *